United States Patent [19]

Miller

[11] Patent Number: 4,703,280

[45] Date of Patent: Oct. 27, 1987

[54] FLUID CONDUCTIVITY SENSOR CONTROLLING AN ELECTRO EXPLOSIVE DEVICE

[75] Inventor: Francis M. Miller, Snyder, N.Y.

[73] Assignee: Conax Florida Corporation, St. Petersburg, Fla.

[21] Appl. No.: 771,354

[22] Filed: Aug. 30, 1985

[51] Int. Cl.[4] ..... G01N 27/02; F23Q 7/02

[52] U.S. Cl. ..... 324/439; 340/620; 294/82.29; 244/151 B; 361/251

[58] Field of Search ..... 324/439, 446, 449, 450; 294/82.25, 82.29; 24/603; 244/151 B; 361/251; 340/620

[56] References Cited

U.S. PATENT DOCUMENTS

| | | | |
|---|---|---|---|
| 2,938,429 | 5/1960 | Jaglowoski, Jr. et al. | 89/1.14 |
| 3,498,131 | 3/1970 | Rickey | 340/620 X |
| 3,994,049 | 11/1976 | Johansen et al. | 24/602 |
| 4,023,846 | 5/1977 | Poehlmann | 294/82.29 |
| 4,024,440 | 5/1977 | Miller | 361/251 |
| 4,137,527 | 1/1979 | Tennenhouse et al. | 340/620 |
| 4,227,190 | 10/1980 | Kelly et al. | 340/604 |
| 4,253,628 | 3/1981 | Marek | 244/151 A |
| 4,307,858 | 12/1981 | Noah et al. | 244/151 B |
| 4,382,231 | 5/1983 | Miller | 324/439 |
| 4,513,248 | 4/1985 | Miller | 324/439 |

*Primary Examiner*—Gerard R. Strecker
*Assistant Examiner*—Robert W. Mueller
*Attorney, Agent, or Firm*—Christel, Bean & Linihan

[57] ABSTRACT

A circuit for sensing the electrical conductivity of fluid comprising a pair of electrodes adapted to be exposed to the fluid, a voltage source connected to one of the electrodes, a load connected to the other of the electrodes, a firing circuit branch including a firing capacitor connected to the other electrode, a conductivity sensing circuit branch including a sensing circuit capacitor connected to the other electrode and to the voltage source, and characterized by a switch connected in controlled relation to the sensing circuit branch and in controlling relation to the firing circuit. In response to the electrodes being exposed to fluid having a predetermined condition of electrical conductivity, current flows in the sensing circuit branch which operates the switch to connect the firing circuit in a manner preparing it for firing, i.e. charging the capacitor therein. After a predetermined time, i.e. after the firing capacitor is charged, the switch operates to connect the firing circuit to the load for operating the same. The sensing capacitor is selected to charge significantly more rapidly than the firing capacitor. A current regulator is connected between the voltage source and load. The switch can be a relay with the control coil thereof in the sensing circuit branch. The load can be an electro explosive device in a release mechanism for uncoupling a parachute canopy from its load upon landing in water.

21 Claims, 5 Drawing Figures

FLUID CONDUCTIVITY SENSOR CONTROLLING AN ELECTRO EXPLOSIVE DEVICE

BACKGROUND OF THE INVENTION

This invention relates to the art of sensing the electrical conductivity of fluid, and more particularly to a new and improved apparatus for sensing and signalling the presence of liquid having a predetermined electrical conductivity.

One area of use of the present invention is detonating an electro explosive device of a release mechanism for uncoupling a parachute canopy upon landing in water, although the principles of the present invention can be variously applied. In the design of such release mechanisms it is obviously desirable to provide the highest possible reliability in terms of operating at the proper time and preventing accidental detonation. In addition to providing specific measures to accomplish the foregoing, it would be highly desirable to provide for use with such release mechanisms conductivity sensing apparatus having the smallest possible number of components to enhance the probability of achieving the highest possible reliability.

SUMMARY OF THE INVENTION

It is, therefore, a primary object of this invention to provide a new and improved apparatus for sensing the electrical conductivity of fluid.

It is a more particular object of this invention to provide such apparatus which is highly reliable in operating in response to fluid having a predetermined condition of conductivity and not being susceptible to inadvertent or accidental operation in response to fluid not having such predetermined condition of conductivity.

It is a further object of this invention to provide such apparatus having the fewest possible number of components so as to enhance the probability of achieving highly reliable operation.

It is a further object of this invention to provide such apparatus which is relatively simple in structure and is relatively economical to produce.

It is a further object of this invention to provide such apparatus for use with an electro explosive device of a release mechanism for uncoupling a parachute canopy from its load upon landing in water.

The present invention provides a circuit for sensing the electrical conductivity of fluid comprising a pair of electrodes adapted to be exposed to the fluid, a voltage source connected to one of the electrodes, a load connected to the other of the electrodes, a firing circuit branch including energy storage means in the form of a firing capacitor connected to the other electrode, a conductivity sensing circuit branch including energy storage means in the form of a sensing circuit capacitor connected to the other electrode and to the voltage source, and characterized by switching means connected in controlled relation to the sensing circuit branch and in controlling relation to the firing circuit. In response to the electrodes being exposed to fluid having a predetermined condition of electrical conductivity, current flows in the sensing circuit branch which operates the switching means to connect the firing circuit in a manner preparing it for firing, i.e. charging the capacitor therein. After a predetermined time, i.e. after the firing capacitor becomes charged, the switching means operates to connect the firing circuit to the load for operating the same. The sensing capacitor is selected to charge significantly more rapidly than the firing capacitor. A current regulating means is connected between the voltage source and load. The switching means can be a relay with the control coil thereof in the sensing circuit branch.

The foregoing and additional advantages and characterizing features of the present invention will become clearly apparent upon a reading of the ensuing detailed description wherein:

BRIEF DESCRIPTION OF THE DRAWIN FIGURES

DETAILED DESCRIPTION OF THE ILLUSTRATED EMBODIMENTS

Figure 1:
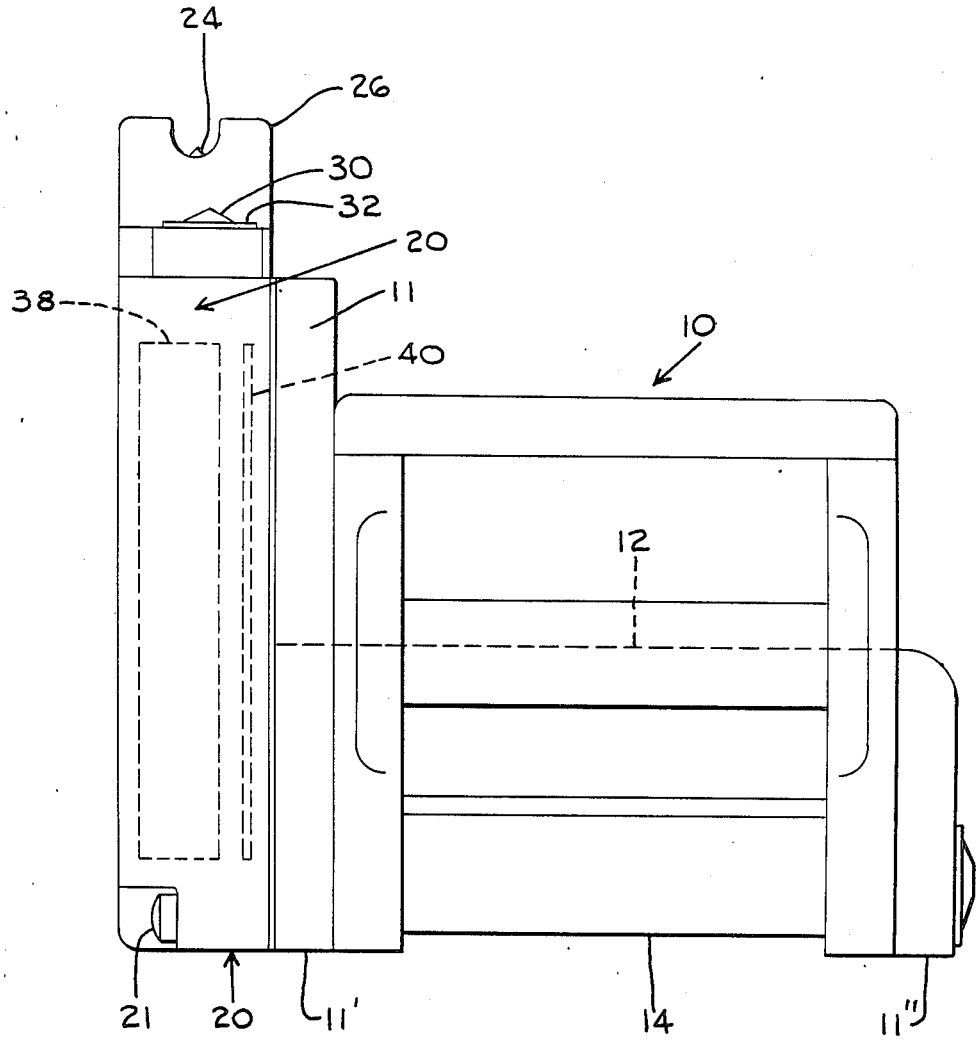
FIG. 1 is a elevational view showing an illustrative canopy release mechanism with which the present invention can be utilized.

Referring now to FIG. 1 the apparatus of the present invention, generally speaking, is for sensing the electrical conductivity of a fluid, and one particular use illustrated herein is with a release mechanism for upcoupling a parachute canopy from its load upon landing in water. FIG. 1 illustrates a portion of a form of canopy release mechanism wherein the locking bar buckle half or body 10 of an illustrative canopy release assembly is shown. A canopy adjuster (not shown) is coupled to the buckle half or canopy release body 10 under control of a conventional double acting manually operable latch mechanism (not shown) in a known manner. An adapter plate 11 has arms 11', 11'', which are joined by a web 12 spanning the canopy release body 10. In the release mechanism shown, a detachable sleeve 14 replaces the existing pin, sleeve and retaining screw (not shown) in a known manner. An adapter plate 11 has arms 11,11'' which are joined by a web 12 spanning the canopy release body 10. In the release mechanism shown, a detachable sleeve 14 replaces the existing pin, sleeve and retaining screw (not shown) of the usual canopy assembly. The releasing sleeve 14 has a longitudinal bore in which a release piston (not shown) is positioned. The left hand end of the piston as viewed in FIG. 1 extends beyond sleeve 14 into one end of a plug (not shown) which is fitted into the adapter plate arm 11' and extends into an opening in one arm of the buckle yoke to receive the end of the piston. The opposite end of sleeve 14, i.e. the right hand end as viewed in FIG. 1, is held in place by a bushing (not shown) which is seated in the open end of the sleeve and extends into an opening in the other arm of the buckle yoke. The piston and bushing can be held in position by shear pins to maintain the mechanism in an engaged position.

The plug associated with the left hand end of the piston as viewed in FIG. 1 contains an electro explosive device (not shown in FIG. 1) and which is adapted to be fired by operation of the fluid conductivity sensor of the present invention. Typically, the device includes a cartridge at the end adjacent the piston and a pair of electrical leads extending from the opposite end of the electro explosive device for supplying electrical current thereto. By way of example, an electro explosive device which will operate satisfactorily in this apparatus is available commercially from Conax Corporation, Buffalo, N.Y. under the designation Part CC-131.

Figure 2:
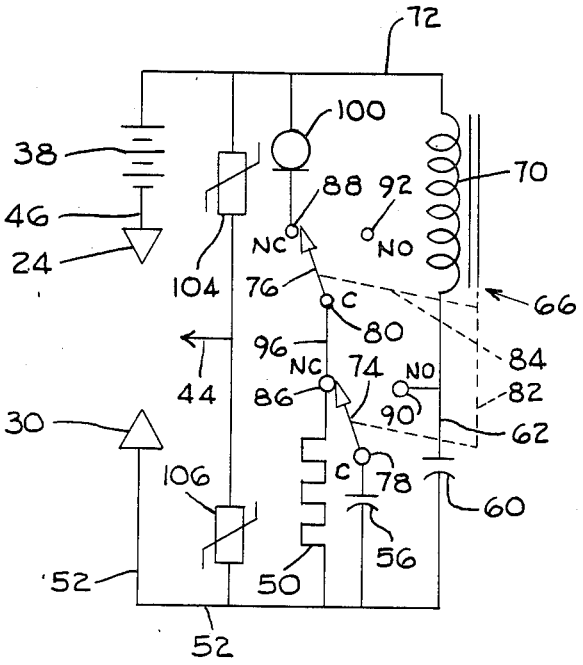
FIG. 2 is a schematic circuit diagram of apparatus for sensing electrical conductivity of fluid and operating a load according to the present invention.

A housing generally designated 20 is attached to adapter plate 11 by suitable means, for example mounting screws one of which is designated 21. One end of housing 20 is provided with sensing electrode means. In particular, a first electrode 24 is located within an open end cup shaped formation 26 of insulative material, for example Teflon, for electrically insulating electrode 24 from the remainder of the housing as shown in FIG. 2. An insulating epoxy (not shown) is provided for positioning and holding electrode 24 in place. There is provided a second electrode 30 at the same end of the housing in spaced relation to electrode 24 and it is received within a rim-like structure 32 of insulative material, for example Teflon, for electrically insulating electrode 30 from the housing. An insulating epoxy (not shown) is provided for positioning and holding electrode 30 in place.

The housing 20 has a main body portion provided with an interior chamber which contains a voltage source in the form of a battery designated 38 in broken lines. A sensing and firing circuit is provided on a board 40 shown in broken lines located in the main body portion near battery 38, and the circuit will be described in detail presently. The electrodes 24, 30 battery 38, circuit and electro explosive device are connected electrically in a circuit in a manner which will be described.

Briefly summarizing the operation of the apparatus shown in FIG. 1, when electrodes 24, 30 are exposed to fluid such as water having predetermined conditions of electrical conductivity, the circuit functions to supply after a predetermined time a firing current to the electro explosive device to detonate the same. The resulting explosive force acting against the face of the piston shears the pin holding the same and drives the piston to the right as viewed in Fig. 1. This displaces the end of the piston from the aforementioned plug and the yoke arm to the point within the sleeve 14, thereby releasing the piston end, the left hand end as viewed in FIG. 1, of the sleeve 14 from the buckle frame. After a short distance of axial travel within the sleeve 14, the opposite end of the piston strikes the end of the bushing shearing its pin and driving the bushing into the right as viewed in FIG. 1 out of the sleeve 14 thereby freeing the bushing end of sleeve 14 from the buckle frame. Sleeve 14 then drops free of the buckle yoke releasing a load from the canopy. The piston and bushing are wedge and lodged in their respective release positions within the structure thereby precluding any possibility of rebound to interface with release of the sleeve 14 from the buckle frame. For a more detailed description of the construction and operation of the canopy release mechanism shown in FIG. 1, reference may be made to U.S. Pat. Nos. 4,307,858 issued Dec. 29, 1981 entitled "Canopy Release Mechanism", 4,382,231 issued May 3, 1983 entitled "Fluid Conductivity Sensor" and 4,513,248 issued Apr. 23, 1985, entitled "Fluid Conductivity Sensor" all assigned to the assignee of the present invention, the disclosures of each of which are hereby incorporated by reference.

FIG. 2 illustrates in further detail the apparatus for sensing electrical conductivity of a fluid according to the present invention. The apparatus includes a pair of electrodes adapted to be exposed to the fluid. By way of example, when used in a canopy release mechanism as shown in FIG. 1, the electrodes are the sensing electrodes 24 and 30. In the circuit shown in FIG. 2, the housing 20 serves as a ground or reference, and line 44 connects a circuit reference point to housing 20. The apparatus further comprises a voltage source having a pair of terminals, one of which is connected to one of the afore-mentioned electrodes. In the circuit shown, the voltage source comprises a battery 38 and the negative terminal of battery 38 is connected by a conductor designated 46 to the electrode 24.

The apparatus further comprises a load 50 coupled to the other of the electrodes. In particular, load 50 comprises an electro explosive device having a pair of terminals, one of which is connected by a line 52 to sensing electrode 30. The other terminal of load 50 is connected to the remainder of the circuit in a manner which will be described. The apparatus further comprises a firing circuit branch connected to the other electrode. In particular, the branch comprises energy storage means in the form of a firing capacitor 56, one terminal of which is connected to line 52 leading to electrode 30 and the other terminal of which is connected to the remainder of the circuit in a manner which will be described.

The apparatus further comprises a conductivity sensing circuit branch connected to the other electrode and to the voltage source. In particular, the branch comprises energy storage means in the form of a sensing capacitor 60, one terminal of which is connected to line 52 leading to electrode 30, and the other terminal of which is connected by line 62 and by means to be described to the positive terminal of battery 38.

The apparatus further comprises switching means generally designated 66 connected in controlled relation to the sensing circuit branch and in controlling relation to the firing circuit branch. As will be described in further detail presently, switching means 66 connects the firing circuit branch, i.e. firing capacitor 56, in a manner preparing the firing branch for firing in response to current flow in the conductivity sensing branch, i.e. sensing capacitor 60, when electrodes 24,30 are exposed to fluid having a predetermined condition of conductivity, and then switching means 66 connects the firing circuit branch to the load, i.e. the electro explosive device 50, a predetermined time thereafter for operating the load. In the apparatus shown, switching means 66 is in the form of a relay having a control coil 70, one terminal of which is connected to line 62 and the other terminal of which is connected by a line 72 to the positive terminal of battery 38. The relay is of the double pole-double throw type and further comprises a pair of switch arms 74 and 76 movably connected to relay terminals 78 and 80, respectively, and operatively connected to coil 70 in a known manner as represented by broken lines 82 and 84, respectively. Switch arms 74 and 76 normally engage corresponding normally closed relay contacts 86 and 88, respectively, when coil 70 is not energized. In response to energization of coil 70, switch arms 74 and 76 are moved out of engagement with contacts 86 and 88 and are moved into engagement with a pair of normally open contacts 90 and 92, respectively.

In the circuit of FIG. 2, the other terminal of load 50 is connected to normally closed contact 86, the other terminal of firing capacitor 56 is connected to relay terminal 78, and contact 86 is connected by a line 96 to relay terminal 80. Normally open contact 90 is connected to coil 70 by a line 62, and normally open contact 92 is not connected in the circuit. The apparatus further comprises current regulator means 100 in the form of a current regulator diode normally connected between the voltage source and load 50. In particular, regulator 100 is connected between the positive terminal of battery 38 and the normally closed relay contact 88. There is also provided the series combination of Varistors 104 and 106 connected between the positive terminal of battery 38 and electrode 30 for protecting against static discharge. The junction of Varistors 104 and 106 is connected by line 44 to the housing 20.

The circuit of FIG. 2 operates in the following manner. In the illustrative use of the apparatus in a canopy release mechanism, the specified all fire condition is water having a conductivity of 10,000 micromhos or greater, i.e. seawater. Prior to electrodes 24,30 being exposed to such water, the circuit is in the condition of FIG. 2. At the instant electrodes 24,30 are exposed to such water, current flows from battery 38 through the water between electrodes 24 and 30 and to sensing capacitor 60 which charges up very quickly causing current flow through coil 70 to energize the relay 66 momentarily and move switch arms 74 and 76 from the position of FIG. 2 to the position of FIG. 3 where they engage contacts 90 and 92, respectively. This is because entering seawater from air exposes electrodes 24,30 to a fluid having a sufficient magnitude or degree of conductivity under conditions providing a sufficient rate of change in conductivity of fluid to which electrodes 24,30 are exposed. Since relay coil 70 has some resistance, the time constant of the sensing circuit branch is determined by the magnitude of the capacitor 60 and the resistance of coil 70.

Figure 3:
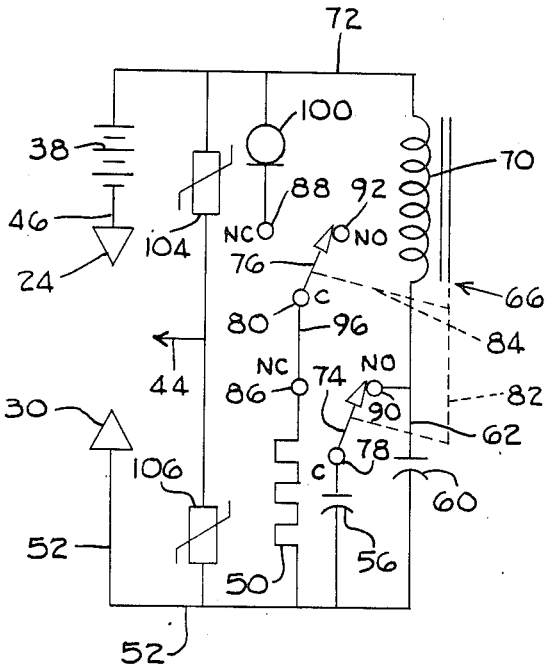
FIG. 3 is a schematic circuit diagram similar to FIG. 2 and illustrating operation of the apparatus.

With the circuit in the state or condition of FIG. 3, the firing capacitor 56 charges up at a rate relatively slower than that of sensing capacitor 60. The flow of current is from battery 38 through the water between electrodes 24,30 through capacitor 56 through coil 70 back to battery 38. Thus, with the circuit in the condition of FIG. 3, in response to the initial current flow in the sensing branch at the instant when electrodes 24,30 were first exposed to the seawater, the firing circuit branch is connected in the circuit in a manner preparing it for firing, i.e. charging of capacitor 56. The firing capacitor 56 maintains current in relay coil 70 until the capacitor becomes almost fully charged. While capacitor 56 is charging, the circuit branch including regulator 100 is opened thereby allowing the full power of battery 38 to be used in the charging circuit. Then, due to lack of coil current, the relay 66 drops out and the switch arms 74 and 76 revert back to the position of FIG. 1 wherein they engage contacts 86 and 88, respectively. This, in turn, results in firing capacitor 56 dumping its charge through the electro explosive device 50 causing explosive ingnition thereof.

The foregoing illustrates the all fire mode of operation wherein the apparatus functions to cause controlled explosive ignition of electro explosive device 50. As previously described, in the illustrative use of the apparatus in a canopy release mechanism, the specified all fire condition is water having a conductivity of 10,000 micro mhos or greater, i.e. seawater. During the no-fire mode of operation, the function of the circuit of FIGS. 2 and 3 is to prevent explosive ignition of electro explosive device 50. This would, of course, include normal dry atmospheric conditions where the circuit is completely dormant due to the fact that sensing electrodes 24,30 being exposed to dry atmosphere are insulated from each other with the result that the negative terminal of battery 38 is separated from the circuit of FIGS. 2 and 3 by sensing electrodes 24,30. This also occurs when the environment becomes slightly conductive such as when electrodes 24,30 are exposed to rain, salt water spray and fog. Such conditions of rain, salt water spray and fog typically are encountered by stationary aircraft on a carrier vessel at sea.

In particular, during rain conditions wherein electrodes 24,30 are exposed to water having a conductivity of 1000 micro mhos or less, the exposure of electrodes 24,30 to this slightly conductive environment does allow a small current flow between electrodes 24,30 and thus in the circuit. However, current regulator 100 functions to keep the flow of current through electro explosive device 50 at a very low level, significantly below the current necessary to fire the device 50. This operation of regulator 100, in turn, maintains a very low voltage across sensing capacitor 60 which is low enough to prevent energization of relay coil 70. Thus, during rain conditions, regulator 100 maintains a minimum voltage on the sensing capacitor 60. However, this minimum voltage is small enough that if the sensing electrodes 24,30 are first exposed to rain and then enter seawater, the relay coil 70 will be energized. The foregoing typically occurs when the parachute and person wearing the same descend through rain into seawater. For example a minimum voltage of 5 volts is maintained on sensing capacitor 60 by regulator 100 during rain conditions. This 5 volt level on capacitor 60 is not sufficient to energize relay coil 70 during rain conditions. However, the difference between the voltage of battery 38 and the foregoing minimum voltage, i.e. 25 volts minus 5 volts equals 20 volts, provides a sufficient amount of voltage, i.e. 20 volts, for capacitor 60 to charge further up to when electrodes 24,30 are exposed to seawater thereby enabling the circuit to energize relay 66 and fire the electro explosive device. Thus, the circuit prevents accidental detonation during rain conditions, but provides firing when entering seawater after descending through rain.

Under salt fog conditions, the fluid to which electrodes 24,30 are exposed provides essentially a short circuit between the electrodes. Regulator 100 limits the current flow through electro explosive device 50 to a relatively low value, for example 6.2 ma, which is significantly below the current level needed to fire device 50. Sensing capacitor 60 charges up slowly to a voltage level approaching the battery voltage, for example 25 volts, and as a result the firing capacitor 56 remains connected to contact 86 in the condition of FIG. 2. Thus, during salt fog conditions, the sensing capacitor 60 effectively blocks the voltage caused by the slowly rising conductivity. If sensing capacitor 60 should happen to short out due to failure or malfunction, the voltage which was across capacitor 60 then is across the coil 70. This is practically the full battery voltage of 25 volts. Relay coil 70 will energize and move switch 76 to the position of FIG. 3 connecting firing capacitor 56 to coil 70. However, because capacitor 60 is shorted out, firing capacitor 56 is held in the position of FIG. 3 indefinitely and cannot be switched back to the position of FIG. 2. Therefore accidental firing of device 50 is prevented. Thus, if sensing capacitor 60 should happen to short circuit prior to or during salt fog or other high conductivity conditions, the relay 66 will energize but firing capacitor 56 is rendered ineffective by being connected across that same short circuit, i.e. across the shorted capacitor 60.

In the event that sensing capacitor 60 should fail and create an open circuit under salt fog or other high conductivity conditions, the voltage level approaching battery voltage, for example 25 volts, remains across the open circuit capacitor 60. As a result, relay 66 cannot energize and firing capacitor 56 remains connected to contact 86 in the position of FIG. 2. Regulator 100 continues to limit the current flow through device 50 to a level well below that needed to operate the device.

In selecting the relative magnitudes of sensing capacitor 60 and the resistance of coil 70, selecting too small a magnitude of capacitor 60 is avoided to prevent the situation where relay coil 70 cannot be energized. Similarly, selection of too large a value for capacitor 60 is avoided to prevent accidental energization of relay coil 70 during rain conditions.

In the circuit of FIGS. 2 wherein the explosive device 50 is in series with current regulator 100, this allows very simple verification of bridgewire conductivity, proper battery voltage and positive no-fire testing by allowing direct access to the battery and electro explosive device through the sensing electrodes 24,30. This is because during testing through the electrodes 24,30 there is access to just the circuit branch or loop including battery 38, regulator 100 and electro explosive device 50. In other words, electrodes 24,30 battery 38 and electro explosive device 50 are arranged in the circuit in a series loop.

Figure 4:
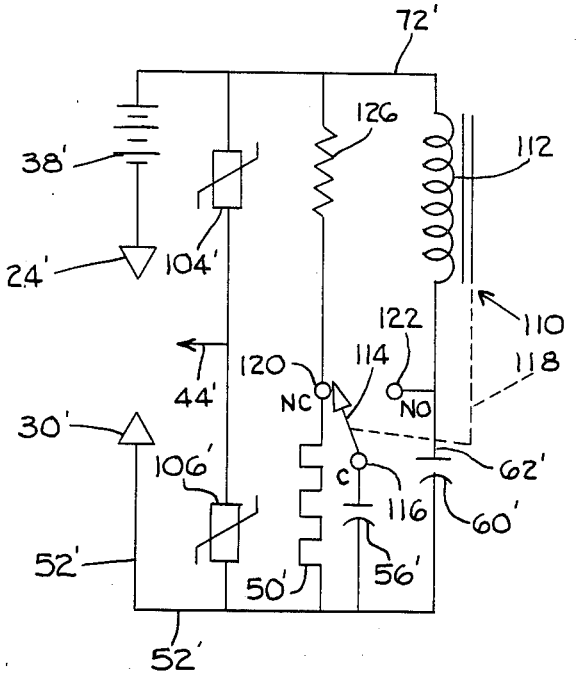
FIG. 4 is a schematic circuit diagram of apparatus for sensing electrical conductivity of fluid and operating a load according to another embodiment of the present invention.
Figure 5:
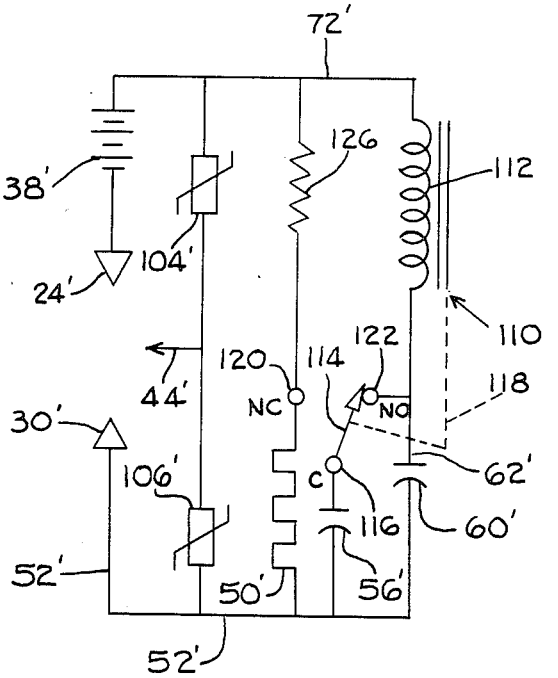
FIG. 5 is a schematic circuit diagram similar to FIG. 4 and illustrating operation of the apparatus.

FIGS. 4 and 5 illustrate apparatus according to another embodiment of the present invention wherein the circuit is constructed in a further simplified form. In FIGS. 4 and 5, circuit components identical to those in circuit of FIGS. 2 and 3 are identified by the same reference numerals with a prime designation. In this embodiment, there is also provided switching means generally designated 110 which, like switching means 66 of the previous embodiment, operates to connect the firing circuit branch in a manner preparing it for firing and thereafter connects that firing branch to the load for operating the same. In this embodiment, the switching means also is a relay, but it is a single pole-double throw type in contrast to the double pole-double throw type of FIGS. 2 and 3. In particular, switching means 110 is in the form of a relay having a control coil 112, one terminal of which is connected to line 62' and the other terminal of which is connected by line 72' to the positive terminal of battery 38'. The relay further comprises a switch arm 114 movably connected to a relay terminal 116 and operatively connected to coil 112 in a known manner as represented by broken line 118. Switch arm 114 normally engages a normally a closed contact 120 when coil 112 is not energized. In response to energization of coil 112, switch arm 114 is moved out of engagement with contact 120 and moved into engagement with a normally open contact 122. Thus, the provision of the single pole, single throw relay in the circuits of FIGS. 4 and 5 provides one aspect of further simplification of the circuit of the present invention.

In the circuit of FIG. 4 and 5 the other terminal of load 50' is connected to normally closed contact 120, the other terminal of firing capacitor 56' is connected to relay terminal 116, and normally open contact 122 is connected to line 62'.

By way of further simplification, the current regulator of the circuit of FIGS. 2 and 3 is replaced by a resistor, this being possible due to the fact that the resistor in combination with the relay acts like a current regulator as will be described. In particular, the circuit of FIGS. 4 and 5 includes a resistor 126 connected between line 72' and normally closed contact 120. Thus, the series combination of resistor 126 and load 50' as shown in FIG. 4 is connected between the positive of terminal battery 38' and electrode 30'.

The circuit of FIG. 4 operates in the following manner. When electrodes 24', 30' are exposed to water having conductivity of ten thousand micro mho or greater, i.e. seawater, current flows from battery 38' through the water between electrodes 24', 30' and to sensing capacitor 60' which charges up very quickly as in the circuit of FIG. 2 and causes current flow through coil 112 to energize relay 110 momentarily and moves switch arm 114 from the position of FIG. 4 toward the position of FIG. 5 wherein it engages contact 122. The time constant of the sensing circuit branch is determined by the magnitude of capacitor 60' and the resistance of coil 112.

With the circuit in the state or condition of FIG. 5, the firing capacitor 56' charges up at a rate relatively slower than that of sensing capacitor 60'. The flow of current is from battery 38' through the water between electrodes 24', 30' through capacitor 56' through coil 112 back to battery 38'. Thus, with the circuit in the condition of FIG. 5, in response to the initial current flow in the sensing branch at the instant when the sensing electrodes 24' 30' are first exposed to the seawater, the firing circuit branch is connected in the circuit preparing it for firing, ie. charging of capacitor 56'. The firing capacitor 56' maintains current in relay coil 112' until the capacitor becomes almost fully charged. While capacitor 56' charges, the resistor 126 limits the current flow through device 50' to a small value. Then, due to lack of coil current, the relay 110 drops out and switch arm 114' reverts back to the position of FIG. 4 wherein it engages contact 102. This, in turn, results in firing capacitor 56' dumping its charge through the electro explosive device 50' causing explosive ignition. As compared to the operation of the circuit of FIGS. 2 and 3, when relay coil 12 reaches the drop out current value, there is a slightly smaller voltage across capacitor 56' at the time it is discharged through device 50' but the voltage level is more than adequate for proper firing.

During rain conditions when a small amount of current flows between electrodes 24', 30' and thus in the circuit, resistor 126 limits the flow of current through electro explosive device 50' to a very low level significantly below the current necessary to fire the device 50'. This function of resistor 126 maintains a very low voltage across capacitor 60' which is low enough to prevent energization of relay coil 112. Thus, during rain conditions, resistor 126 maintains a minimum voltage on the sensing capacitor 60'. However, as in the circuit of FIGS. 2 and 3, this minimum voltage is small enough that if the sensing electrodes 24', 30' are first exposed to rain and then enter seawater, the relay coil 112 will be energized. Thus, the circuit of FIGS. 4 and 5, like the circuit of FIGS. 2 and 3, prevents accidental detonation of device 50' during rain conditions, but provides proper firing when entering seawater after descending through rain.

Under salt fog conditions, when electrodes 24',30' are exposed to fluid providing essentially short circuit therebetween, resistor 126 limits the current flow through electro explosive device 50' to a relatively low value significantly below the current level needed to fire device 50'. Sensing capacitor 60' charges up slowly to a level approaching the voltage of battery 38' and firing capacitor 56' remains connected to contact 120 in the circuit of FIG. 4. As compared to the operation of the circuits of FIG. 2 and 3, resistor 126 drains battery 38' into a slightly lower level than that caused by regulator 100. Thus, as in the circuit of FIGS. 2 and 3, during salt fog conditions the sensing capacitor 60' of the circuit of FIGS. 4 and 5 effectively blocks the voltage caused by the slowly rising conductivity. If sensing capacitor 60' should happen to short out, the voltage which was across capacitor 60', which is practically the full battery voltage, then is across coil 112. This energizes relay coil 70' and moves switch arm 114 to the position of FIG. 5 connecting firing capacitor 56' to coil 70'. However, because capacitor 60' is shorted out, firing capacitor 56' is held in the position of FIG. 5 indefinitely and cannot be switch back to the position of FIG. 4. Therefore accidental firing of device 50' is prevented. Thus, as in the circuit of FIGS. 2 and 3, if sensing capacitor 60' should happen to short circuit prior to or during salt fog or other high conductivity conditions, the relay 110 will energize but firing capacitor 56' is rendered ineffective by being connected across that same short circuit, i.e. the shorted capacitor 60'.

In the event that sensing capacitor 60' should fail and create an open circuit under salt fog or other conductivity conditions, the voltage level approaching that or battery 38' remains across the open circuit of capacitor 60'. As a result, relay 110 cannot energize and firing capacitor 56' remains connected to contact 120 in the position of FIG. 4. Resistor 126 continues to limit the current flow through device 50' at a level well below that needed to operate the device.

As in the circuit of FIGS. 2 and 3, in selecting magnitudes of sensing capacitor 60' and the resistance of coil 112, consideration is given to avoiding too small a magnitude of capacitor 60' to prevent a situation wherein relay coil 112 cannot be energized, and to avoiding too large a value for capacitor 60' to prevent accidental detonation of relay coil 112 during rain conditions.

As in the circuit of FIGS. 2 and 3, electro explosive device 50' is in series with current regulating resistor 126 and allows very simple verification of bridgewire conductivity, proper battery voltage and positive no-fire testing by allowing direct access to the battery and the electro explosive device through the sensing electrodes 24',30'. This is because during testing through the electrodes 24',30' there is access to just the circuit branch or series loop including battery 38', current regulating resistor 126 and electro explosive device 50', with electrodes 24',30' being part of that loop.

As previously described, in the circuit of FIGS. 4 and 5 resistor 126 provides a current regulating function. Accordingly, in the circuit of FIGS. 2 and 3, regulator 100 could be replaced by a single 1K resistor connected between conductor 72 and contact 88 or by the parallel combination of two 2K resistors connected between conductor 72 and contact 88. The resistors preferably are of the metal film type. Since a current regulator like regulating diode 100 looks like an open circuit when a large voltage is applied to it, when regulating diode 100 is replaced by a resistor, the opening of the relay switch arm away from contact 88 connected to the resistor accomplishes a similar current regulating function. Similarly, the current regulating resistor 126 in the circuit of FIGS. 4 and 5 could be replaced by the current regulating diode 100 from the circuit of FIGS. 2 and 3.

The relays 66 and 110 in the circuits of FIGS. 2–5 have the advantages of providing truly opened and truly closed states or conditions. There may be situations where other forms of switching means, for example semiconductor switching means and solid state switching means, can be employed as alternatives for relays 66,110.

By way of example, in an illustrative circuit, electrode 24,24' is of stainless steel, electrode 30,30' is of aluminum, battery 38,38' is 25 volt Mn02 type, electro explosive device 50,50' is Conax Part CC-131 previously described, firing capacitor 56,56' has a magnitude of about 820 micro farads± 10% at 15 volts d.c., sensing capacitor 60,60' has a magnitude of about 10 microfarads±10% at 35 volts d.c., current regulating diode 100 is rated at 6.2 milliamperes±10%, resistor 126 is a 1k metal film type and varistors 104,104' and 106,106' are General Electric V68MA3B. Relay 66 is a DBDT 5 volt, 60 ohm±10% type commercially available from Teledyne under model no. J432D-SL. A 1K resistor (not shown) can be connected across electro explosive device 50,50' for safety or protective purposes to prevent inadvertent firing by preventing a voltage build-up across the circuit connections to device 50,50'' while it is temporarily removed during replacement or repair. In a circuit according to the present invention with the foregoing illustrative component values and under nominal seawater conditions, the total operational time, from exposure of the electrodes to seawater to firing of the electro explosive device, is about 0.09–1.0 second.

It is therefore apparent that the present invention accomplishes its intended objects. The circuits of FIGS. 2–5 provide apparatus for sensing the electrical conductivity of fluid which is highly reliable in operating in response to fluid having a predetermined condition of conductivity and not being susceptible to inadvertent or accidental operation in response to fluid not having such predetermined condition of conductivity. Significantly, this is accomplished by circuits having the fewest possible number of components so as to enhance the prbability of achieving highly reliable operation and to provide a structure which is relatively simple in structure and is relatively economical to produce. When the fluid conductivity sensing apparatus of the present invention is used for detonating an electro explosive device of a release mechanism for uncoupling a parachute canopy upon landing inwater, it provides the highest possible reliability in terms of operating at the proper time and preventing accidental detonation.

While embodiments of the present invention have been described in detail, that is for the purpose of illustration, not limitation.

I claim:

1. A circuit for operating a load in response to a predetermined condition in the electrical conductivity of a fluid comprising:

(a) a pair of sensing electrodes adapted to be exposed to the fluid for defining a circuit path therebetween when the fluid has electrical conductivity;

(b) a voltage source connected to one of the electrodes;

(c) a current conducting load coupled to another of the electrodes;

(d) a firing circuit branch connected to the other electrode;

(e) a conductivity sensing circuit branch connected to the other electrode and to said voltage source; and (f) switching means connected to said sensing circuit branch in a manner controlled thereby and in controlling relation to said firing circuit branch for connecting said firing circuit branch in a manner preparing said firing circuit branch for firing in response to current flow in said conductivity sensing branch when said electrodes are exposed to fluid having a predetermined condition of conductivity and for connecting said firing circuit to said load a predetermined time thereafter in a manner completing a circuit including said load and said firing circuit branch to provide current flow from said firing circuit branch through said load for operating said load.

2. A circuit according to claim 1, wherein said firing circuit branch includes energy storage means in the form of a capacitor.

3. A circuit according to claim 1, wherein said conductivity sensing circuit branch includes energy storage means in the form of a capacitor.

4. A circuit according to claim 1, further including current regulating means connected in a portion of said circuit including said voltage source and said firing circuit branch when said switching means connects said firing circuit to said load.

5. A circuit according to claim 4, wherein said current regulating means comprises a current regulator diode.

6. A circuit according to claim 4, wherein said current regulating means comprises a resistor.

7. A circuit according to claim 1, wherein said firing circuit branch comprises a firing capacitor, said conductivity sensing circuit branch comprises a sensing capacitor and said switching means has a first state normally connecting said firing capacitor to said load and is switchable to a second state connecting said firing capacitor to said conductivity sensing circuit branch in a manner charging said firing capacitor in response to current flow in said conductivity sensing circuit branch when said electrodes are exposed to fluid having a predetermined condition of conductivity, said switching means then connecting said firing capacitor to said load for operating the same a predetermined time thereafter.

8. A circuit according to claim 1, wherein said load is an electro explosive device which is detonated when electrical energy of a predetermined magnitude is applied thereto.

9. A circuit according to claim 8, wherein said electro explosive device is included in a release mechanism for uncoupling a parachute canopy from its load upon landing in water, said canopy being uncoupled when said electro explosive device is detonated, and said electro explosive device being detonated when said sensing electrodes are exposed to water having said predetermined condition of conductivity.

10. A circuit according to claim 1, wherein said conductivity sensing circuit branch includes a sensing capacitor and wherein the connection of said switching means to said conductivity sensing circuit branch provides resistance in series with said sensing capacitor.

11. A circuit according to claim 1, wherein said pair of electrodes, voltage source and load are connected in said circuit in a series loop thereby allowing direct access to said voltage source and said load through said electrodes for testing purposes.

12. A circuit according to claim 1, wherein said switching means comprises a relay with the control coil thereof in said conductivity sensing circuit branch.

13. A circuit for operating a load in response to a predetermined condition in the electrical conductivity of a fluid comprising:

(a) a pair of sensing electrodes adapted to be exposed to the fluid for defining a circuit path therebetween when the fluid has electrical conductivity;

(b) a voltage source connected to one of said electrodes;

(c) a current conducting load coupled to another of said electrodes;

(d) a firing circuit branch including a firing capacitor connected to said other electrode;

(e) a conductivity sensing circuit branch including a sensing capacitor connected to said other electrode and to said voltage source; and (f) switching means connected to said sensing circuit branch in a manner controlled thereby and in controlling relation to said firing capacitor, said switching means having a first state normally connecting said firing capacitor to said load and switchable to a second state connecting said firing capacitor to said conductivity sensing circuit in a manner charging said firing capacitor in response to current flow in said conductivity sensing circuit branch when said electrodes are exposed to fluid having a predetermined condition of conductivity, said switching means then connecting said firing capacitor to said load a predetermined time thereafter in a manner completing a circuit including said load and said firing circuit branch to provide current flow through said load for operating said load.

14. A circuit according to claim 13, further including current regulating means connected between said firing capacitor and said voltage source when said switching means is in said first state.

15. A circuit according to claim 14, wherein said current regulating means comprises a current regulator diode.

16. A circuit according to claim 14, wherein said current regulating means comprises a resistor.

17. A circuit according to claim 13, wherein said load is an electro explosive device which is detonated when electrical energy of a predetermined magnitude is applied thereto.

18. A circuit according to claim 17, wherein said electro explosive device is included in a release mechanism for uncoupling a parachute canopy from its load upon landing in water, said canopy being uncoupled when said electro explosive device is detonated, and said electro explosive device being detonated when said sensing electrodes are exposed to water having said predetermined condition of conductivity.

19. A circuit according to claim 13 wherein the connection of said switching means to said conductivity sensing circuit branch provides resistance in series with said sensing capacitor.

20. A circuit according to claim 13, wherein said pair of electrodes, voltage source and load are connected in said circuit in a series loop thereby allowing direct access to said voltage source and said load through said electrodes for testing purposes.

21. A circuit according to claim 13, wherein said switching means comprises a relay with the control coil thereof in said conductivity sensing circuit branch.

* * * * *